United States Patent [19]

Last

[11] 4,098,356

[45] Jul. 4, 1978

[54] PILE DRIVERS

[75] Inventor: Anthony Edward Walter Last, Stowmarket, England

[73] Assignee: BSP International Foundations Limited, Ipswich, England

[21] Appl. No.: 766,611

[22] Filed: Feb. 7, 1977

[30] Foreign Application Priority Data

Feb. 20, 1976 [GB] United Kingdom ..... 6872/76

[51] Int. Cl.[2] ..... B25D 9/00

[52] U.S. Cl. ..... 173/131; 173/139

[58] Field of Search ..... 173/137, 138, 139, 131

[56] References Cited

U.S. PATENT DOCUMENTS

| | | | |
|---|---|---|---|
| 2,575,619 | 11/1951 | Ditson | 173/138 |
| 2,979,033 | 4/1961 | Bassinger | 173/137 |
| 3,547,207 | 12/1970 | Warrington | 173/138 |
| 3,789,930 | 2/1974 | Nishimura et al. | 173/139 |

*Primary Examiner*—Robert A. Hafer

*Attorney, Agent, or Firm*—Larson, Taylor and Hinds

[57] ABSTRACT

A pile driver operated by a pressure supply of compressible fluid has a cushioning fluid chamber for transmitting the driving pulses to a pile. Both the cushioning chamber and the working chambers for generating the driving pulses are connected to an enclosed space from which the exhaust flow of fluid is able to escape by way of muffler means. The cushioning chamber draws in air at or near atmospheric pressure by way of said space which is in permanent communication with the exterior through the muffler means.

8 Claims, 3 Drawing Figures

PILE DRIVERS

BACKGROUND OF THE INVENTION

This invention relates to pile drivers arranged to be operated by a compressible fluid and is concerned with reducing the noise of operation of such machines.

A well-recognised disadvantage of conventional pile drivers is that they are very noisy in operation. This is partly because they rely on using a large mass as a hammer or ram to strike an anvil on the pile to drive the pile into the ground, and in the case of drivers operated by compressible fluid such as compressed air or steam partly because of the release and exhaust of pressure fluid at the required stages of a reciprocating cycle. Various attempts have been made to lessen the noise of operation, e.g. by constructing a sound-insulating enclosure within which the hammer or ram moves but this is extremely cumbersome.

It is known to place non-metallic shock-absorbing blocks or dollies between the striking parts to avoid metal-to-metal contact but this does not substantially reduce noise and does not have any effect at all on the noise produced by release of pressure fluid.

The admission of gas under pressure has also been proposed for producing a fluid cushion that prevents direct impact. In one arrangement (U.S. Pat. No. 3,714,789) compressible fluid is injected under the falling mass shortly before it reaches the bottom of its reciprocating stroke to produce a fluid cushion decelerating the mass and then accelerating its initial return upwards, after which the pressurised cushioning fluid is released. This proposed arrangement is very complex and therefore expensive to manufacture. In another arrangement (UK Pat. No. 1 396 575) a ram cylinder is alternately connected to a pressure source and to exhaust in order to produce a series of pressure pulses underneath a weighted ram piston to generate a periodic driving force, the pressure being so regulated that the ram piston is kept out of contact from a dolly or impact-absorbing pad on the pile. This result can only be achieved when the ground resistance to the pile is low because the peak cushioning pressures are limited by the delivery pressure of the pump supplying the ram, there being a return flow through the pressure delivery line when the cushion pressure exceeds the normal line pressure.

SUMMARY OF THE INVENTION

According to the invention, there is provided a pile driver comprising a piston mounted in a casing in a manner defining upper and lower annular chambers within the casing for a compressible working fluid and reciprocable therein to generate a driving pulse in each descending stroke, there being a lower space below the piston in which compressible fluid is arranged to be trapped during the descent of the piston to decelerate the piston and cause the driving pulse to be transmitted through the trapped fluid, and respective connecting means from said working chambers and said lower space to muffling or silencing means for an exhaust flow of the fluid from the driver.

It is preferably arranged that the lower space is supplied with fluid from a region directly upstream of the silencing means, e.g. said connection means, so that no additional pressure fluid is required for the fluid cushion, and indeed the inflow to the lower space can be at or near to atmospheric pressure. By providing an arrangement that does not rely on a supply of fluid under pressure to provide the cushioning effect, it is possible to develop greater peak forces for a given volume of cushioning chamber in retarding the falling mass, and thus higher driving forces on the pile.

In a preferred construction, said annular chambers are bounded by an inner peripheral wall within the casing closely fitting a bore in the piston to form an inner space therewith that contracts with the expansion of the lower space, and said connection means comprise at least one conduit between said inner and lower spaces for counterflow of the fluid between said spaces, said inner space being part of or adjacent to the silencing means.

Advantageously, the fluid from said annular chambers is arranged to exhaust into said inner space and it is then possible to achieve a particularly compact arrangement by disposing the silencing means at least partly within said inner space. In fact, by arranging that the maximum volume of said inner space is relatively large in comparison with the exhaust flow, it can itself contribute to the silencing function, while its own noise emission may be muffled to some extent by the jacketing effect of the annular working chambers.

BRIEF DESCRIPTION OF THE DRAWING

In the accompanying drawings

DESCRIPTION OF THE PREFERRED EMBODIMENTS

Figure 1:
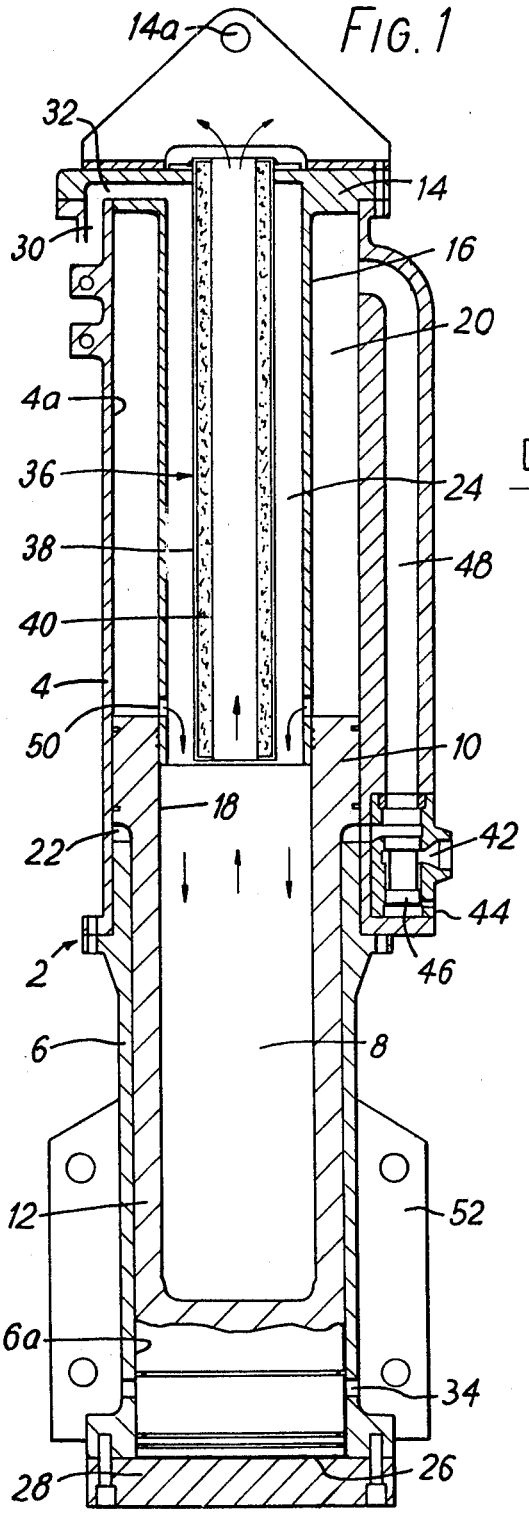
FIG. 1 is a diagrammatic axial section of one embodiment of pile driver according to the invention.
Figure 2:
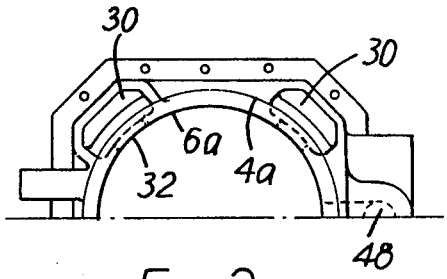
FIG. 2 is a diagrammatic half plan view of the casing of the driver in FIG. 1, illustrating the cushioning space connection means.

Referring to FIGS. 1 and 2 of the drawings, the driver has an outer casing 2 comprising upper and lower outer cylinders 4, 6 bolted together and the upper cylinder having an internal bore 4*a* concentric with but of larger diameter than an internal bore 6*a* of the lower cylinder. A stepped piston 8 reciprocable in the outer casing has a head 10 sealingly fitting the upper internal bore 4*a* and a stem 12 depending below the head and sealingly fitting the lower bore 6*a*. The top of the upper cylinder bore 4*a* is closed by a cover 14 with a suspension eye 14*a* and from the cover there depends a tube 16 that projects into a central bore 18 in the piston. The upper cylinder bore 4*a* and the tube 16 together form an annular space divided by the piston head 10 into upper and lower annular chambers 20, 22 which function as working chambers for a compressible fluid to reciprocate the piston.

An inner space 24 exists within the tube 16 and piston bore 18, and since the piston stem 12 is closed at its bottom end there is a further separate lower space 26 formed in the casing lower outer cylinder between the bottom of the piston and a pressure plate 28, bolted to the casing, through which the working pulses of the driver are transmitted. In the inoperative state shown in the drawing the piston stem 12 rests on the pressure plate 28, but as will be clear from the description below of the operation of the pile driver, in use the stem does not descend so far as to contact the plate 28.

The spaces 24, 26 are able to communicate through a series of conduits 30 (FIG. 2). Each conduit extends between an opening 32 at the top of the space 24 and an opening 34 a small distance above the bottom of the space 26, as indicated in FIG. 1 (although these openings are actually offset from the plane of FIG. 1, as is clear from FIG. 2). The space 24 also communicates with the exterior through a silencer or muffler unit 36 extending into the space and comprising an open tube 38 with a lining 40 of sound-absorbent material, e.g. mineral wool, acting in known manner to attenuate pressure peaks and muffle exhaust noise. Other known forms of muffler can be used, such as the multiple chamber type comprising in its simpler forms a perforated jacket surrounding and spaced from an outlet conduit.

The driver is operated by a supply of compressible fluid, e.g. pressure air, to an inlet 42 of a control valve 44, substantially of the form described and illustrated in UK Pat. No. 1 212 975 to which reference can be made for a fuller description of the construction and functioning of the valve. With the control valve piston 46 at its rest position shown, the compressed fluid is first admitted through the valve to the annular working chamber 22 where it acts on the underside of the piston head 10 to raise the piston. In the resulting contraction of the upper annular working chamber 20, the pressure in that upper chamber increases and eventually acts through conduit 48 to switch the valve 44. The two chambers 20, 22 are then interconnected through the conduit 48, this producing changes in the chamber pressures that allow the piston to descend in its working stroke. Near the end of the fall of the piston, exhaust porting 50 in the tube 16 is uncovered and pressure fluid in the upper chamber escapes into the inner space 24 and thence, through the silencer unit 36, to the outside. The resulting pressure drop in the upper chamber causes the valve 44 to switch again to repeat the cycle.

During the rise of the piston, fluid in the contracting inner space 24 transfers through the conduits 30 to the expanding lower space 26, the pressures in these two spaces being close to atmospheric as there is little change in their combined volume and there is free communication to the exterior through the silencer unit 36. During the fall of the piston, the flow occurs in the opposite direction until the conduit openings 34 are closed as the piston stem approaches the pressure plate, so that fluid is then trapped in the space 26 to cushion the final part of the fall of the piston and metal-to-metal contact between the piston and plate is avoided. In this way the driving pulse is transmitted to the pile by the trapped cushion of fluid and the noise is lessened.

Because the pressure in the cushioning chamber is initially close to atmospheric there will at first be only insignificant retardation of the piston. The pressure will increase very rapidly as the piston comes closer to the pressure plate so that by the stage the piston's fall is stopped a very high peak pressure will have developed and will act as a driving pulse on the pile. By contrast, if pressure fluid were initially admitted to the space 24 it would immediately begin to reduce the momentum of the piston and the maximum peak force would be less. Although it might be possible to provide an arrangement that would develop a similar peak force using a high pressure supply, it would be necessary to reduce the size of the cushioning space, in particular the minimum volume would be smaller and a more complex structure and in particular elaborate sealing arrangements would then be necessary, as conventional piston sealing rings are effective only at some distance from the end of their piston.

As it may be expected that there will be a tendency for the driver to bounce from the pile when the piston reverses into its return stroke, lugs 52 are provided for the attachment of pile grips. The grips are not illustrated but preferably they take the form described in UK Pat. No. 1 320 146, obtaining their gripping action from pressure fluid tapped from the working fluid supply to the annular chambers. It can be arranged that the pile grips are cyclically released and re-engaged by controlling the compressed fluid supply to them in synchronism with the operation of the driver, in known manner, and in that case it is preferably also arranged that the compressed fluid released from the grips is exhausted by way of the inner space 24 and silencer unit 36.

The construction illustrated is a particularly compact arrangement although it is also possible for the silencer unit to be mounted externally of the casing. However, in the form shown, it is possible for the inner space 24 to function as a relatively large volume receiver for the pressure air emitted through the exhaust porting 50 so that the inner space itself contributes to the silencing effect.

The silencer unit can be relatively small since substantially all the flow through it will be represented by the exhaust flow from the annular working chambers and that flow is kept relatively small by virtue of the interchange of fluid between the upper and lower annular chambers during part of the working cycle. The flows that take place between the inner space 24 and lower space 26 are to a great extent self-balancing and at some stages there is in fact a net inflow through the silencer unit to these spaces.

Figure 3:
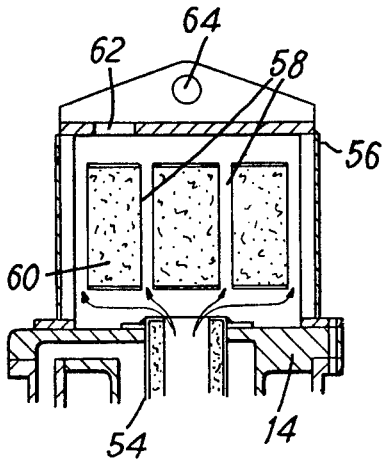
FIG. 3 is a detail view of a modified silencing arrangement for the driver of FIG. 1.

FIG. 3 illustrates a modified silencer or muffler in which in addition to an internal tubular silencer 54 that can be of the lined form illustrated in FIG. 1 or of the perforated jacket form also described above, there is an outlet box 56 providing multiple paths 58 through sound-absorbing material 60 to an exhaust opening 62. The box is mounted on the outer casing cover 14 and has on its top face a lifting eye 64.

It is to be noted that since the illustrated arrangement requires only a single external pressure fluid supply line and single exhaust, it can be easily arranged for underwater operation.

What is claimed is:

1. A pile driver comprising a casing, a piston slidably mounted in the casing, upper and lower annular working chambers formed within the casing for a compressible working fluid, the piston being reciprocable in the casing by the fluid for generating a series of driving pulses, a lower space in the casing under the piston means for containing compressible fluid in said lower space in each descending driving stroke of the piston whereby to transmit a driving pulse through the contained fluid under pressure, the driver further comprising muffler means and respective connection means from the working chambers and the lower space leading released fluid therefrom to the muffler means for an exhaust flow from the driver.

2. A pile driver according to claim 1 having an internal space in or adjacent the muffler means from which the compressible fluid is supplied to said lower space.

3. A pile driver according to claim 1 wherein an axial bore is provided in the piston and a sleeve internally of the casing closely fits said bore, an inner space being formed by said sleeve and bore that contracts with the expansion of the lower space and that is part of or adjacent to the muffler means, said connection means from the lower space leading to said inner space for counterflow of the fluid between said spaces.

4. A pile driver according to claim 3 comprising exhaust means for leading fluid from the annular working chambers to said inner space.

5. A pile driver according to claim 4 wherein the inner space has a maximum volume that is relatively large in relation to the flow of working fluid through said exhaust means whereby the inner space forms a chamber in which pressure peaks in the exhaust flow are attenuated.

6. A pile driver according to claim 3 wherein the muffler means comprises at least one conduit at least partly within said inner space.

7. A pile driver according to claim 1 wherein the muffler means comprise an open-ended tube and a lining of sound-absorbent material in said tube.

8. A pile driver comprising a casing, an inner sleeve fixed in said casing defining an annular space therewith, a piston slidable in the casing having an axial bore closely fitting the sleeve, upper and lower working chambers formed by the piston in said annular space and an inner space formed by said sleeve and piston bore, means for supplying compressible fluid under pressure to said working chambers for generating a series of driving pulses, a lower space in the casing under the piston, means for trapping compressible fluid in said lower space during each driving stroke whereby to transmit a driving pulse through the trapped fluid under pressure, connection means between said lower and inner spaces for a counterflow of fluid therebetween and between said inner space and the working chambers for an exhaust flow from the chambers, muffler means mounted in the casing providing communication between said inner space and the exterior for an outlet flow from the driver.

* * * * *